United States Patent [19]

Robbins et al.

[11] 4,379,003

[45] Apr. 5, 1983

[54] MAGNETIC DEVICES BY SELECTIVE REDUCTION OF OXIDES

[75] Inventors: Murray Robbins, Berkeley Heights; Richard C. Sherwood, New Providence, both of N.J.

[73] Assignee: Bell Telephone Laboratories, Incorporated, Murray Hill, N.J.

[21] Appl. No.: 173,641

[22] Filed: Jul. 30, 1980

[51] Int. Cl.[3] ..... H01F 1/02

[52] U.S. Cl. ..... 148/104; 148/126; 148/31.55; 148/126.1; 419/19; 419/31

[58] Field of Search ..... 148/104, 105, 126, 31.55; 75/200, 206, 211

[56] References Cited

U.S. PATENT DOCUMENTS

| | | | |
|---|---|---|---|
| 1,669,648 | 5/1928 | Bandur | 148/104 |
| 3,019,103 | 1/1962 | Alexander et al. | 75/206 |
| 3,166,416 | 1/1965 | Worn | 75/206 |
| 3,180,727 | 4/1965 | Alexander et al. | 75/206 |
| 3,326,677 | 6/1967 | Alexander et al. | 75/206 |
| 3,425,822 | 2/1969 | Lambert | 75/206 |
| 4,069,043 | 1/1978 | Ackermann | 75/206 |
| 4,101,348 | 7/1978 | Berchtold | 148/105 |

FOREIGN PATENT DOCUMENTS 1100993 9/1955 France .

OTHER PUBLICATIONS

Green et al., "Properties of Fe-50 w/o Ni Alloys Prepared by Diecl Hydrogen Reduction of Mixed Oxide Preforms", the International Journal of Powder Metallurgy and Powder Technology, vol. 16 No. 2, 1980, pp. 131-147.

*Primary Examiner*—John P. Sheehan

*Attorney, Agent, or Firm*—Peter V. D. Wilde; James H. Fox

[57] ABSTRACT

Magnetic material is made by reducing an oxide powder compact having at least one nonreducible oxide species. A typical mixture of nickel, iron, and aluminum oxides selectively reduces to form a material having a typical permeability of 10 or more and high resistivity. Reduced eddy current losses occur in devices made from such material.

8 Claims, No Drawings

MAGNETIC DEVICES BY SELECTIVE REDUCTION OF OXIDES

BACKGROUND OF THE INVENTION

1. Field of the Invention

This invention relates to a method of making magnetic materials and devices therefrom.

2. Description of the Prior Art

Magnetic materials that are of commercial significance typically fall into two broad categories: ferromagnetic and ferrimagnetic. The so-called "soft" ferromagnetic materials are typically characterized by high permeability and low resistivity. The ferrimagnetic materials, on the other hand, tend to have somewhat lower permeabilities but significantly higher resistivities due to their oxide form. For higher frequency applications, the ferrimagnetic materials are often chosen, as their high resistivities result in low eddy current losses in devices made therefrom.

If ferromagnetic materials are to be used in certain applications, including high frequency applications, steps are typically taken to reduce the eddy current losses in such materials. For example, it is known that magnetic devices made by powder metallurgy techniques have somewhat lower eddy current losses than parts cast from a melt, due to the greater porosity and hence higher resistivity of the powder metallurgy material. A method of further increasing the resistivities of powder metallurgy materials which have inherently low resistivities, such as nickel, iron, cobalt, etc., is to coat the metal powder particles with an insulting material prior to compacting the powder and sintering. Typical insulating materials that have been used include colloidal clay, kaolin, milk of magnesia, and sodium silicate. Another known technique to increase resistivity is to oxidize the surface of metal powder grains before compaction. In addition, steps are typically taken to minimize the size of the metal powder particles, as smaller grain sizes typically result in lower eddy current losses. These steps typically include adding a small amount of sulfur to a melt of the magnetic metals, in order to embrittle the resultant metal. This allows smaller powder particles to be obtained upon grinding the metal, and may increase the resistivity of the particles. Other techniques to minimize eddy current losses, particularly in powder transformers, include making the devices of thin layers or laminations that are insulated from each other, or by choosing an alloy with a high electrical resistivity, such as silicon steel.

It would be desirable to find additional methods for obtaining low loss soft ferromagnetic materials for a wide variety of applications.

SUMMARY OF THE INVENTION

We have invented a method of making magnetic material by selectively reducing an oxide powder compact. The oxide powder includes at least one oxide of a magnetic metal that will reduce in a subsequent heating step, and at least one oxide that will not so reduce. Typically, prior to compaction, each oxide powder particle comprises a mixture, solid solution, or compound of the reducible and nonreducible oxides. The oxides may additionally be sintered after the compaction step. The compacted oxides are then heated in a reducing environment, thereby reducing the reducible metal oxide or oxides to a metal. The nonreducible oxide substantially migrates to the grain boundaries of the magnetic material during the reducing step, thereby rendering the magnetic material substantially insulated.

DETAILED DESCRIPTION

The following description relates to a method of making magnetic material having increased resistivity. We have discovered that by including a suitable nonreducible oxide in a compacted mixture of powdered oxides of magnetic materials it is possible to increase the resistivity of the magnetic material that forms upon reduction. The nonreducible oxide species itself is typically not magnetic, but serves to effectively insulate the grains of the magnetic metal species. With a suitably chosen nonreducible species and suitable processing methods, it is possible to obtain usefully high permeability of the magnetic material. Nonreducible oxides are known in the prior art to increase the coercivity of magnetic material; i.e., to form "hard" magnetic material. It is surprising to find that an oxide can be introduced that both insulates and maintains suitable soft magnetic properties upon reduction of an oxide compact.

In the following discussion, it will be recognized that the amount of nonreducible oxide necessary to achieve insulation of the magnetic material is very significant in determining the magnetic properties of the material. For example, with certain nonreducible oxides, it has been found that such a large percentage must be included in the oxide mixture that the resultant insulated magnetic material loses its useful magnetic properties; that is, the permeability becomes unusably low. With the inclusion of a suitably chosen oxide, typically aluminum oxide ($Al_2O_3$), it is possible to both insulate the magnetic grains that form during reduction and obtain useful magnetic properties; that is, a permeability of 10 or more in typical embodiments. The magnetic metals typically include at least one of the elements iron, nickel, and cobalt, with various other elements occasionally being included for desirable magnetic or mechanical properties such as molybdenum, copper, etc. It has been found that the nature of the reducible magnetic metal oxide is typically not critical in determining the insulating properties of the magnetic material that forms upon reduction, but rather the nature of the nonreducible oxide typically is critical for obtaining the desirable insulating properties noted above.

In order to obtain the desired migration to grain boundaries, the nonreducible oxide species should have a crystal structure that is dissimilar from that of the magnetic metal. For example, $Al_2O_3$ has a hexagonal unit cell, while Ni-Fe alloys typically have a cubic unit cell. Furthermore, the unit cell of the nonreducible species is preferably larger than the unit cell of the magnetic metal. These will help ensure low solubility of the nonreducible oxide in the magnetic metal. Also, the nonreducible oxide should be a ceramic material in nature, wherein little grain growth occurs during heating. This helps to ensure that an insulating "film" will form around the magnetic metal. Otherwise, the nonreducible oxide typically forms discontinuous islands that do not insulate the magnetic metal, except at very large concentrations of the nonreducible oxide, which would be detrimental to the magnetic properties. Both optical microscopy and scanning electron microscopy (SEM) have been used to determine that $Al_2O_3$ migrates to grain boundaries of Ni-Fe alloys as desired. Other oxides meeting these criteria can also be used.

In addition, to obtain the desired migration of the nonreducible oxide species to the grain boundaries of the reducible magnetic metals, typically the oxide powder particles each contain both the reducible and nonreducible oxide species. This provides for relatively short migration distances for the nonreducible species to the grain boundaries, with the oxide particles typically being less than 100 microns in diameter. The oxide powder particles may be in the form of a solid solution or compound of the various oxides, including ferrite particles. The oxide powder particles may alternately be in the form of a mixture of oxide species within each particle to form "agglomerates". These agglomerates are typically formed by spray-drying, freeze-drying, or coprecipitation so that the individual oxide species subsist as submicron regions mixed in agglomerates that are typically several tens of microns in diameter.

It is also possible to sinter the oxide compact in air or another nonreducing atmosphere for structural integrity prior to reduction. In the Example below, this is accomplished by heating the compact in air for several hours at a temperature typically in the range of 600–800 degrees C. This typically removes any organic binder material present and imparts a degree of structural integrity to the compact.

In addition to the type and percentage of the nonreducible oxide, another important parameter in determining the resulting magnetic properties is the temperature of reduction. The higher the reduction temperature, typically the higher the density of the resulting magnetic material and the higher the permeability. On the other hand, if the temperature exceeds a certain critical temperature, the magnetic metallic grains "punch through" the surrounding oxide at the grain boundaries, and the material loses its high resistivity, becoming essential metallic again in its resistance. For purposes of this invention, material having a macroscopic resistivity (i.e., measured over a sample size comprising a multiplicity of grain boundaries) of less than 1.0 ohm-centimeters is considered uninsulated, while material having a macroscopic resistivity of at least 1.0 ohm-centimeters is considered insulated.

The transition from essentially uninsulated to essentially insulated material typically occurs within a fairly narrow temperature range. For example, with nickel-iron magnetic material and $Al_2O_3$ nonreducible species comprising about 4 percent by weight of the total magnetic material, the transition typically occurs at a reduction temperature between 1050 and 1100 degrees C. This transition temperature is also related to the amount of nonreducible oxide species, with greater amounts of nonreducible species resulting in a higher transition temperature, but typically with reduced permeability. Generally, in practicing the present invention, the weight percentage of $Al_2O_3$ as the nonreducible species is greater than 3 percent in order to achieve insulation of the reduced compact, and less than 10 percent for acceptable magnetic properties. The reduction temperature is typically in the range of 600 to 1100 degrees C. The lower reduction temperatures generally provide for higher porosity and lower permeability of the magnetic material, but this is advantageous in certain high frequency circuits to obtain reduced losses. The above principles and procedures will be more fully illustrated by means of the following examples:

EXAMPLE 1

Iron ammonium citrate, nickel ammonium citrate, and aluminum ammonium citrate in the proper proportions to form a magnetic material of 48 percent nickel, 48 percent iron, and 4 percent aluminum oxide by weight were spray-dried, and then decomposed to form oxide agglomerates by heating at 800 degrees C. in air for approximately 4 hours. The oxide agglomerates were then combined with a binder of halowax, and compacted under a pressure of 25,000 psi (172.5 MPa) into toroids having an outside diameter of 2.25 centimeters, an inside diameter of 1.25 centimeters, and a thickness of 0.5 centimeters. The binder was burned off at a temperature of 600 degrees C. for about 4 hours. The oxide compact was reduced in hydrogen gas at a temperature of 650 degrees C. for 4 hours. The resulting magnetic material was substantially insulated, having a resistance of over 100,000 ohms as measured across the outside diameter of the toroid. The material had a density of about 2.46 grams per cubic centimeter, which is about 30 percent of theoretical maximum density. The above-noted dimensions of the toroid after reduction were about 20 percent lower than before reduction, being about 1.8 centimeters outside diameter, 1.0 centimeters inside diameter, and 0.4 centimeters thickness. The initial DC permeability was approximately 10, as measured in a field of 10 oersteds. This aluminum oxide insulated nickel-iron magnetic core was compared with a 50 percent nickel—50 percent iron core of comparable dimensions and density, and prepared by the same reduction procedure as above, except that no aluminum oxide was included. The permeability of the uninsulated core was also approximately 10. An equal number of turns of wire was wound on both the insulated and uninsulated cores, and measurements of the equivalent AC series resistance were made as a function of frequency. In this test, increasing resistances correspond to higher eddy current and other AC-related losses. The results of this test are indicated in Table 1 below.

TABLE 1

| | AC Series Resistance (Ohms) | |
|---|---|---|
| Frequency (Hz) | 50-50 Ni-Fe | 48-48-4 Ni-Fe-$Al_2O_3$ |
| 1,000 | .05 | .07 |
| 1,800 | .38 | .18 |
| 3,000 | 1.1 | .23 |
| 10,000 | 4.5 | .90 |
| 20,000 | 37 | 1.9 |

It can be seen that at the higher frequencies, the insulated core has significantly lower losses than the uninsulated core.

EXAMPLE 2

Hydrated iron sulfate, $Fe\ SO_4.7H_2O$, hydrated nickel sulfate, $Ni\ SO_4.7H_2O$, and hydrated aluminum ammonium sulfate, $Al_2(SO_4)_3.(NH_4)_2\ SO_4.24H_2O$, in proportions to form a magnetic material having 48 percent nickel, 48 percent iron, and 4 percent aluminum oxide by weight, were dissolved in water and spray-dried. The resulting material was decomposed at 1000 degrees C. in air for approximately 4 hours to form oxide agglomerates. These agglomerates were mixed with a halowax binder and compacted into toroids as in Example 1. The halowax was then removed by heating in air at 600 degrees C. for approximately 4 hours. The compact was then reduced in hydrogen at 1000 degrees C.

for 4 hours. The resulting magnetic material had a density of approximately 3.5 grams per cubic centimeter, which is about 42 percent of theoretical maximum density. The material was substantially insulated, as in Example 1, and had a DC permeability of approximately 20, as measured in a field of 10 oersteds.

EXAMPLE 3

Hydrated iron sulfate, hydrated nickel sulfate, and hydrated aluminum ammonium sulfate, as above, were dissolved in water in proportions so as to yield a magnetic material having 80 percent nickel and 20 percent iron in the metallic portion and having 4 percent $Al_2O_3$ oxide in the total material by weight. The sulfates were spray-dried and calcined at 1000 degrees C. in air for about 4 hours in order to decompose them to oxide agglomerates. The oxide agglomerates were mixed with a halowax binder and compacted into a toroid, as above. The halowax was removed by heating in air at 600 degrees C. for approximately 4 hours. The compact was then reduced in hydrogen at 1050 degrees C. for about 4 hours. The resulting magnetic material had a density of approximately 5 grams per cubic centimeter, which is about 60 percent of theoretical maximum density. The toroid had an initial DC permeability of approximately 40. A DC hysteresis loop was made by switching the toroid in a field of plus and minus 60 oersteds. The remanence was approximately 30 gauss. The toroid was substantially insulated, having a resistance of approximately 100,000 ohms as measured across its outside diameter.

In practicing the present invention, it is typically desirable to keep the weight percentage of nonreducible oxide species less than 10 percent and preferably less than 6 percent in order to obtain relatively high permeability. It has recently been found that the maximum permeability of uninsulated magnetic materials produced by reduction procedures otherwise similar to those described herein is exponentially related to the volume fraction porosity; see, for example, "Properties Of Iron-50 W/O Ni Alloys Prepared By Direct Hydrogen Reduction Of Mixed Oxide Preforms", M. L. Green et al, *The International Journal Of Powder Metallurgy And Powder Technology*, Vol. 16/2, pages 131–147 (April 1980). The permeabilities obtained by the toroids produced herein are found to correlate closely with the permeabilities estimated on the basis of density of magnetic material, according to the above-named article. In such comparisons, note that the nonreducible oxide is considered to be a porous space. For this reason, the properties of $Al_2O_3$ as the nonreducible species are highly advantageous in that insulated magnetic material can be obtained with $Al_2O_3$ percentages of at least as low as 4 percent typically.

However, for certain applications, including high frequency inductors, the permeability need not be especially high in order to obtain useful devices. For example, prior art powdered iron cores having a permeability of 4 are commercially used at frequencies of typically 100 MHz and above. Insulated magnetic material produced by the inventive technique can be advantageously used in such applications. The materials produced by the present technique can also be advantageously used, for example, in power transformers, especially in switching-type powder supplies operating in the kilohertz to several megahertz range. By choosing suitable reducible and nonreducible species in suitable proportions and by varying the density of the compact, as by the choice of reduction temperature as noted above, material suitable for a wide variety of applications can thus be obtained.

The above process has been described in terms of agglomerated oxides, typically wherein the oxides are agglomerated by means of spray-drying of precursor metal salts, which are then decomposed to oxides. Freeze-drying or coprecipitation of metal salts followed by decomposition to oxides are also suitable agglomerating pretreatment steps and are included herein.

The above-described invention has been illustrated by means of certain reducible oxide species and certain nonreducible oxide species. However, other reducible oxide species and other nonreducible oxide species may be found useful in practicing the present invention. A single magnetic metal species, for example iron, can be used. A multiplicity of nonreducible oxide species can be used. The nonreducible oxide may itself partially reduce during the reduction step. For example, $V_2O_5$ may partially reduce to $VO_2$ or $V_2O_3$, while still being considered herein as not substantially reduced. Different reduction techniques may be useful. For example, carbon monoxide gas may be suitable instead of hydrogen for certain materials. Furthermore, the use of carbon or other materials mixed in with the compact may serve as a reducing agent in certain cases. Other techniques may be used to obtain oxide powder particles having the desired composition prior to reduction. For example, ball milling of the separate oxide species followed by a high temperature diffusion step may be useful in obtaining oxide particles in the desired form. All such variations and deviations which basically rely on the teachings through which this invention has advanced the art are properly considered to be within the spirit and scope of this invention.

We claim:

1. A method of making a magnetic material by steps comprising compacting oxide powder comprising at least one oxide species of a magnetic metal, thereby forming an oxide compact, and heating said compact in a reducing environment, thereby reducing said one oxide species to a metal, characterized in that said oxide powder further comprises at least one oxide species which does not substantially reduce during said heating, and which oxide species substantially migrates to grain boundaries of said magnetic metal or alloys thereof during said reducing step, thereby rendering the magnetic material obtained after said reducing step substantially insulated so that the macroscopic resistivity of said magnetic material is at least 1.0 ohm-centimeters.

2. The method of claim 1 further characterized in that each of said oxide powder particles prior to said reducing step is in the form of a compound or solid solution comprising the reducing and nonreducing oxide species.

3. The method of claim 1 further characterized in that each of said oxide powder particles prior to said reducing step is in the form of an agglomerate comprising the reducing and non-reducing oxide species, which species subsist as regions in said agglomerate

4. The method of claim 3 further characterized in that the agglomerates are formed by steps comprising freeze-drying, spray-drying, or coprecipitation of precursor salts, and decomposing said salts to form said agglomerates of said oxides.

5. The method of claim 1 further characterized in that said oxide compact is treated prior to said reduction step by sintering said oxide compact in a nonreducing atmosphere at an elevated temperature.

6. The method of claims 1, 2, 3, 4 or 5 further characterized in that said at least one oxide species of a magnetic metal is an oxide of a metal chosen from the group consisting of iron, nickel, and cobalt.

7. The method of claim 6 further characterized in that said at least one oxide species which does not substantially reduce comprises $Al_2O_3$.

8. The method of claim 7 further characterized in that said magnetic material, when formed in the shape of a toroid having an outside diameter of approximately 1.8 centimeters, and inside diameter of approximately 1.0 centimeters, and a thickness of approximately 0.4 centimeters, and when measured in a field of 10 oersteds, has a DC permeability of at least 10.

* * * * *

UNITED STATES PATENT AND TRADEMARK OFFICE

CERTIFICATE OF CORRECTION

PATENT NO. : 4,379,003

DATED : April 5, 1983

INVENTOR(S) : Murray Robbins and Richard C. Sherwood

It is certified that error appears in the above—identified patent and that said Letters Patent is hereby corrected as shown below:

Column 1, line 17, "higher" should be --high--. Column 1, line 47, "powder" should be --power--. Column 5, line 65, "powder" should be --power--.

Signed and Sealed this

*Seventh* Day of *June 1983*

[SEAL]

*Attest:*

DONALD J. QUIGG

*Attesting Officer*

*Acting Commissioner of Patents and Trademarks*